United States Patent [19]

Okuyama et al.

[11] Patent Number: 4,654,287

[45] Date of Patent: Mar. 31, 1987

[54] INSULATED MAGNET TONER

[75] Inventors: Yuji Okuyama; Kenichi Kishi; Kenzi Tuzita; Tsuyako Ban, all of Hachioji, Japan

[73] Assignee: Konishiroku Photo Industry Co., Ltd., Tokyo, Japan

[21] Appl. No.: 668,038

[22] Filed: Nov. 5, 1984

[30] Foreign Application Priority Data

Nov. 10, 1983 [JP] Japan ..... 58-209881

[51] Int. Cl.[4] ..... G03G 9/14

[52] U.S. Cl. ..... 430/106.6

[58] Field of Search ..... 430/106.6, 107, 109, 430/110

[56] References Cited

U.S. PATENT DOCUMENTS

| | | | |
|---|---|---|---|
| 4,264,648 | 4/1981 | Ziolo et al. | 430/111 |
| 4,404,269 | 9/1983 | Miyakawa et al. | 430/106.6 |
| 4,485,162 | 11/1984 | Imamura et al. | 430/106.6 |

*Primary Examiner*—John L. Goodrow

*Attorney, Agent, or Firm*—Jordan B. Bierman

[57] ABSTRACT

An insulated magnetic toner comprising a binder resin and a powdery magnetic material, said magnetic material being iron or an alloy thereof having a coercive force of not more than 600e.

19 Claims, 6 Drawing Figures

INSULATED MAGNET TONER

BACKGROUND OF THE INVENTION

1. Field of the Invention

The present invention relates to an insulated magnetic toner for use in developing an electrostatic image formed by the electrophotographic process, electrostatic recording process, electrostatic printing process, or the like.

2. Description of the Prior Art

At present, the formation of a visible image according to image information, in most cases, is carried out by way of an electrostatic image. This is performed in the manner that an electrostatic image is formed according to a piece of given image information, the electrostatic image is developed by a developer to obtain a toner image, the toner image is transferred usually onto a sheet of copy paper, the transferred toner image is then fixed, whereby a visible image is formed. As the toner for use in developing an electrostatic image in the above method for the image formation a powdery developer is favorably used because of its ease of handling. The powdery developer is classified as the two-component developer and one-component developer, the former being prepared by mixing a carrier composed of iron powder, glass beads, etc., with a toner composed of a binder resin particles containing a coloring agent, and the like, the latter being composed of a magnetic toner alone which consists of binder resin particles containing a powdery magnetic material, and used without being mixed with a carrier. The one-component developer is more desirable than the two-component developer in respect that it is free in itself from the problem lying in the two-component developer that the toner concentration becomes reduced as the toner is used continually.

However, the magnetic toner which has been used as the conventional one-component developer has the disadvantage that it is difficult to obtain high image density and sharpness in the formed visible image as compared to the two-component developer.

The conventional magnetic toner has the disadvantage that its softening point is generally considerably high. This is due to the fact that, even if a binder resin having a low softening point is used in order to incorporate a large amount of a magnetic material into it for the purpose of increasing the density of a visible image, the softening point as of the toner becomes remarkably high. And, as a result, the fixing temperature must be increased, leading possibly to the occurrence of an under-fixing trouble.

The magnetic toner is classified as conductive magnetic toner having a relatively small resistance and insulating magnetic toner having a relatively large resistance.

Incidentally, in the image formation by the xerographic process, there are image quality-affecting important factors: developability and image transferability. The development by the foregoing conductive magnetic toner, because the development progresses in accordance with the electrostatic induction of a latent image charge, has the advantage that the toner need not have a true electric charge and the induction charge value does not change according to humidity, so that the developability is stable, but, on the contrary, has the disadvantage that a turbulence of the line of electric force occurs when a toner image is transferred by electrostatic image transfer means onto a sheet of copy paper, resulting in the "bleeding" of the transferred image. On the other hand, in the development by the insulated magnetic toner, the insulated magnetic toner has a true electric charge of the polarity opposite to that of the latent image charge, and the development progresses as the result of the electric attraction between the true electric charge of the insulated magnetic toner and the latent image charge, and there is the disadvantage that, because the true electric charge of the insulated toner image is always variable according to humidity, the developability varies, whereas there is the advantage that no turbulence of the line of electric force occurs when a toner image is transferred by image transfer means onto a sheet of copy paper, whereby a "bleeding-free" image can be obtained. Thus, the conductive magnetic toner and insulated magnetic toner have reciprocal properties with respect to the relation between the developability and image transferability. It is therefore difficult to obtain consistent quality images with any of the magnetic toners, and this has been a problem awaiting solution.

As means to solve this problem, an attempt was made to prevent the turbulence of the line of electric force at the time of image transfer to thereby improve the image transferability in the manner that, for example, while a conductive magnetic toner is used to develop a latent image, a resincoated paper is used as copy paper. However, such a coated paper, since it requires a resin-coating process in its manufacture, is costly as compared to plain paper, so that it loses the intrinsic merit of the image transfer process that plain paper can be used. Upon this, another attempt has been made to improve the developability by use of an insulated magnetic toner. For example, Japanese Patent Publication Open to Public Inspection (hereinafter referred to as Japanese Patent O.P.I. Publication) No.31136/1978 describes a method wherein a development is made by charging a toner and applying a bias voltage to the toner. Japanese Patent O.P.I. Publication Nos. 118056/1978 and 22835/1979 describe a method wherein a development is carried out by the use of a toner comprised of a mixture of two magnetic toners different in the resistance. And Japanese Patent O.P.I. Publication No.42141/1979 describes a technique for improving the developability by extremely reducing the thickness of the toner layer in the developing area and also by reducing the interval between the photoreceptor and toner carrier (e.g., a non-magnetic sleeve).

Thus, the above methods have surely improved the developability to a considerable extent even if the insulated magnetic toner is used, but do not yet reach the stage of such developability as obtained by the conductive magnetic toner.

Magnetite and other iron oxides are used as the magnetic material for the conventional magnetic toner. Any of these magnetic materials, because their intensity of saturation magnetization is small, needs to be incorporated in a large quantity into the toner in order to obtain a required magnetic property, such as the intensity of magnetization, for the magnetinc toner. As a result, the conductivity of the magnetic toner is increased, whereas the insulation is lowered, thus resulting in the leakage of the true electric charge of the toner caused by triboelectrically charging; this leakage phenomenon causes the deterioration of developability.

And the large magnetic material content of the toner increases the rate of the magnetic material to appear on the surface of the toner, leading to a large change in the triboelectrically charging characteristic between the individual toner particles or between the toner and other materials. Thus the use of a large quantity of the magnetic material is undesirable because it is disadvantageous for the process. Since magnetite or other iron oxides cause most resins to be negatively charged, this disadvantage becomes conspicuous particularly when obtaining a positively chargeable toner.

The present invention has been made under the above-described background.

OBJECT OF THE INVENTION

It is therefore an object of the present invention to provide an insulated magnetic toner which is capable of forming a satisfactory visible image having high image density and sharpness and which has a low softening point.

SUMMARY OF THE INVENTION

The above object is accomplished by the following insulated magnetic toner: In an insulated magnetic toner comprising a binder resin containing a powdery magnetic material, the insulated magnetic material, wherein the magnetic material is iron or an iron alloy having magnetic properties that the coercive force is not more than 60 Oe and the intensity of saturation magnetization is not less than $150^{emu}/g$.

DETAILED DESCRIPTION OF THE INVENTION

Figure 1:
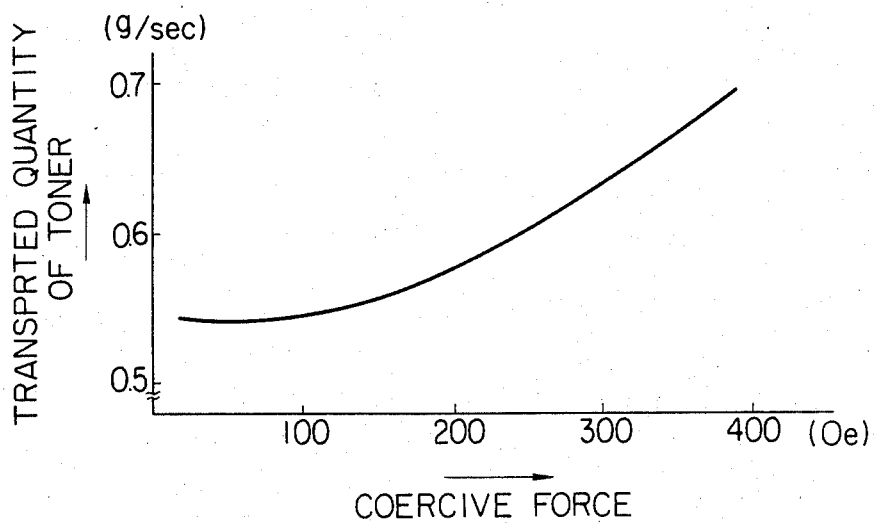
FIG. 1 is a graph showing a curve representing the relation between the coercive force of the magnetic material of and the transported quantity of each magnetic toner.

The present invention will be illustrated in detail below.

In the present invention, a powdery magnetic material having magnetic properties that the coercive force is not more than 60 Oe and the intensity of magnetization in the magnetically saturated condition is not less than $150^{emu}/g$ is dispersed together with a coloring agent and, if necessary, other additives into binder resin particles to thereby prepare an insulated magnetic toner.

The conductivity of this insulated magnetic toner is preferably $10^{-12}$ ℧/cm, and further preferably not more than $10^{-14}$ ℧/cm.

The magnetic material having the above magnetic properties includes iron and alloys containing iron as their principal component. The alloys containing iron as their principal component are those comprised of iron and a single or two or more of other elements including carbon, phosphorus, boron, silicon, aluminum, nickel, cobalt, copper, chromium, zinc, titanium, molybdenum, tungsten and other elements. Such magnetic materials may be used alone or in a mixture of two or more of them.

Any of the above magnetic materials is dispersed in the powdery form of an average particle size of from 0.1 to 1 micron into a binder resin. The magnetic material content percentage of the binder resin is within the range of normally from 20 to 70% by weight so that the intensity of magnetization in the magnetically saturated condition of the resulting toner is, for example, from 25 to $45^{emu}/g$.

The binder resins usable in the present invention include homopolymers obtained by polymerizing monomers including styrenes such as p-chlorostyrene, methylstyrene, etc.; halogenated vinyls such as vinyl chloride, vinyl bromide, vinyl fluoride, etc.; vinyl esters such as vinyl acetate, vinyl propionate, vinyl benzoate, vinyl butyrate, etc.; α-methylenealiphatic monocarboxylic acid esters such as methyl acrylate, ethyl acrylate, n-butyl acrylate, isobutyl acrylate, dodecyl acrylate, n-octyl acrylate, 3-chloroethyl acrylate, phenyl acrylate, methyl α-chloroacrylate, methyl methacrylate, ethyl methacrylate, butyl methacrylate, etc.; vinyl ethers such as acrylonitrile, methacrylonitrile, acrylamide, vinyl-methyl ether, vinyl-isobutyl ether, vinyl-ethyl ether, etc.; vinyl ketones such as vinyl-methyl ketone, vinyl-hexyl ketone, methylisopropenyl ketone, etc.; and other resins including epoxy resins, rosin-modified phenol-formalin resin, cellulose resins, polyether resins, polyvinyl-butyral resins, polyester resins, styrene-butadiene resin, polyurethane resins, polyvinyl-formal resins, melamine resin, polycarbonate resins, fluorine-contained polymers such as Teflon, etc.; and the like. These polymers or resins may be used alone or in a blended mixture.

Of these, styrene-acryl-type resins such as styrene-mthyl methacrylate, styrene-butyl methacrylate, etc., polyester resins, epoxy resins, styrene-butadiene resins, butyral resins, cellulose resins, and the like, are particularly useful.

The preferred coloring agents which may at need be used in the present invention include various organic pigments, dyes, and inorganic pigments, such as, for example, monoazotype, condensed azo-type, azolake-type, and polycyclic-type organic pigments; and anthraquinone-type and phthalocyanine-type dyes. Aside from these coloring agents, carbon black may also be used for preparing a black toner. These coloring agents may be used alone or in a mixture, and contained in a percentage by weight of normally not more than 20 in the finished toner product.

The toner of the present invention may be prepared in similar manner to that of conventional magnetic toners. For example, a powdery magnetic material having specific magnetic properties as previously mentioned is mixed with necessary coloring agents and other additives into a binder resin and then fusedly kneaded, which, after being cooled, is pulverized and classified to thereby prepare a toner. The particle size of the resulting toner is within the range of normally from 5 to 30 microns, preferably 10 to 20 microns.

The toner of this invention is as has been described in above, and capable of forming a visible image having high image density and sharpness because the magnetic material used has specific properties and because, as is apparent from what is described hereinafter, the deposited amount of toner per unit area of the developed image is large. Further, because the toner of this invention can be obtained as of a low softening point, the toner image can be fixed adequately.

To be more particular, the characteristics of the magnetic toner, such as the transportability, developability, softening point, etc., are governed or affected largely by the magnetic properties of the toner, and in addition the magnetic nature of the toner is attributed largely to the magnetic properties and the ratio of the magnetic material used in the toner.

For example, the coercive force Hc(T) of a magnetic toner is determined by the coercive force of the magnetic material used independently of the ratio of the magnetic material in the toner. Accordingly, the magnitude of the coercive force of the magnetic material varies the quantity of the magnetic toner transported by the magnetic transport system. FIG. 1 is a curve representing the relation between the magnitude of the coercive force of each of magnetic materials and the transported quantity of each of toners per centimeter of an eight-magnetic-pole rotary sleeve with a diameter of 40 mm when each of magnetic toners prepared in accordance with the hereinafter described Example 1 by use of various magnetic materials different in the coercive force is transported by the sleeve. As may be understood from this figure, the transported quantity is nearly constant when the magnitude of the coercive force of the magnetic material is not more than 100 Oe, but increases as the coercive force exceeds 100 Oe.

Figure 2:
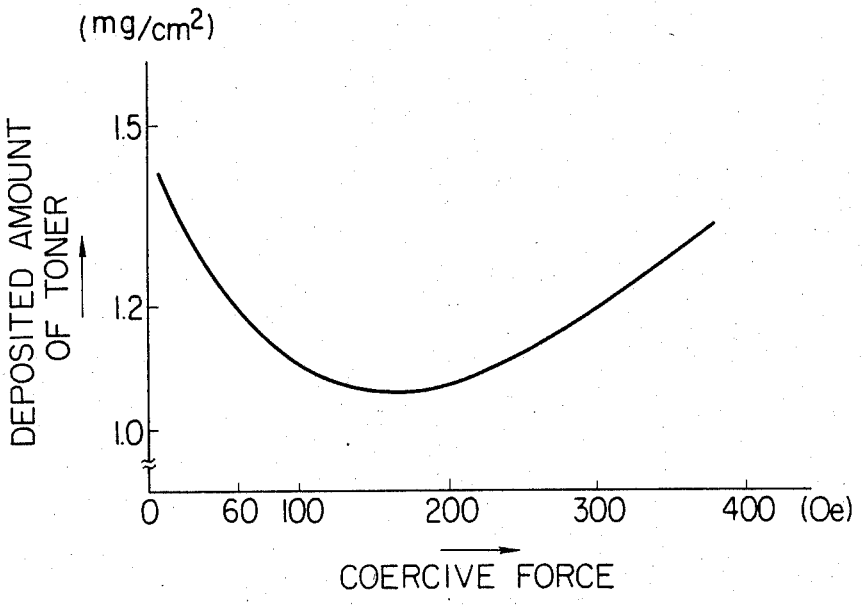
FIG. 2 is a graph showing a curve representing the relation between the coercive force of the magnetic material of and the deposited quantity of each magnetic toner.

FIG. 2 is a curve showing the relation between the magnitude of the coercive force of each magnetic material and the deposited quantity of each toner on an electrostatic image support when magnetic toners containing magnetic materials of the same coercive forces as those in FIG. 1 were used to develop electrostatic images, using an electrophotographic copier U-Bix $V_2$ (manufactured by Konishiroku Photo Industry Co., Ltd.). As may be understood from this figure, when the coercive force of the magnetic material is not more than 60 Oe or not less than 300 Oe, the deposition of the toner exceeds 1.2 mg/cm$^2$, the required image density level. However, when a toner containing a magnetic material of which the magnitude of the coercive force does not fall under the above ranges is used, the deposition of the toner is too small to obtain a sufficiently high image density.

Accordingly, it is obvious that, since the magnetic material used for the toner of the present invention has a coercive force of not more than 60 Oe, electrostatic images can always be developed in a sufficient deposition, thus forming a visible image with a high density. And this is by no means contradictory to the results of FIG. 1, and considered due to the fact that the toner, even if its transported quantity is small, contains a magnetic material whose coercive force is small, so that the coercive force of the toner is also small, and therefore the ratio of the toner particles prone to be transferred from the sleeve by the electrostatic attraction of the electrostatic image and deposited onto the electrostatic image support is large as the absolute amount. On the other hand, conventional methods appear to try to increase the deposition of toner by way of using a large coercive force-having magnetic materials to increase the transporting amount of the toner.

Further, the magnetic material of the toner of this invention, because of its small coercive force, is little cohesive and highly fluid, and therefore can form a sharp and excellent visible image. And it has satisfactory preservability, and hardly coheres even under a high-temperature/high-humidity environment.

Figure 3:
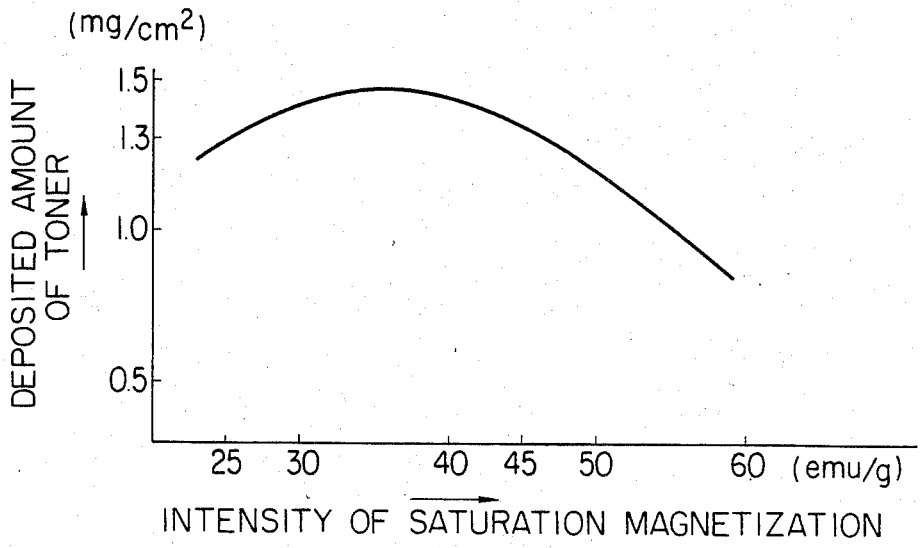
FIG. 3 is a graph showing a curve representing the relation between the intensity of saturation magnetization of and the deposited quantity of each magnetic toner.

FIG. 3 indicates a curve representing the relation between the intensity of saturation magnetization of each magnetic toner and the deposition of the toner when various toners different in the intensity of saturation magnetization by varying the ratio of the magnetic material in the toner are prepared in accordance with the hereinafter described Example 1, and these are used to carry out development in the same manner as in the experiment of FIG. 2. As may be understood from this figure, there can be obtained an image density (1.3 mg/cm$^2$ in this instance) required when the intensity of saturation magnetization of the magnetic toner is from 25 to 45$^{emu}$/g. And in the case where magnetite is used as the magnetic material as in the conventional method, because the intensity of saturation magnetization of magnetite is from about 80 to 90 $^{emu}$/g magnetite must be incorporated in a considerable quantity, or the intensity of saturation magnetization can not be increased to a required magnitude, thus leading to the increase in the softening point of the toner. In contrast, in the present invention, since a magnetic material comprised of iron or an alloy of iron having an intensity of saturation magnetization of not less than 150$^{emu}$/g is used, the softening point of the resulting toner can be made lower than that of a conventional one.

Figure 4:
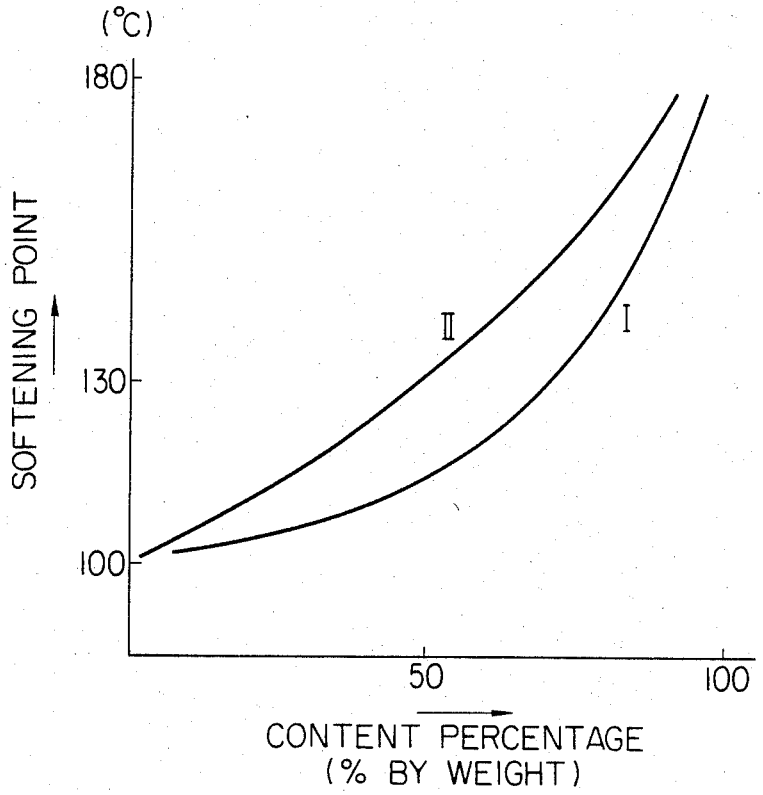
FIG. 4 is a graph showing curves, one curve for iron and the other for magnetite as the magnetic material, each representing the relation between the magnetic material content of and the softening point of each magnetic toner.

FIG. 4 indicates curves representing the results obtained by measuring the softening points of toners by means of an overhead-type flow tester, the toners being prepared in the same manner as in the hereinafter described Example 1 except that iron or magnetite was used as the magnetic material, varying the ratio thereof in the toner. Curves I and II are for iron and magnetite, respectively, each representing the relation between the ratio of the magnetic material in and the softening point of each magnetic toner. As may be understood from this figure, the magnetic toners containing the magnetic material comprised of iron are lower in the softening point than those containing in the same ratio the magnetic material comprised of magnetite, and in each case, the softening point increases with the increase in the ratio of the magnetic material in the toner, but where the magnetic material is iron, the increasing degree of the softening point is smaller than that of the ratio of the material in the toner. And in the present invention, in addition to the use of iron or an alloy of iron as the magnetic material, since the intensity of saturation magnetization of the magnetic material is not less than 150$^{emu}$/g, which is larger than that of magnetite, the ratio of the magnetic material in the toner required for increasing the intensity of saturation magnetization of the magnetic toner to a desirable level of from 25 to 45$^{emu}$/g is so small that the toner of this invention can be of a low softening point, thus enabling to accomplish advantageously consistent, satisfactory fixation. Particularly, that the intensity of saturation magnetization of the magnetic material is not less than 150$^{emu}$/g permits holding down to a level of not more than 20° C. the increase in the softening point of the magnetic toner by the incorporation of the magnetic material even when the intensity of saturation magnetization of the magnetic toner is rendered $45^{emu}/g$.

Figure 5:
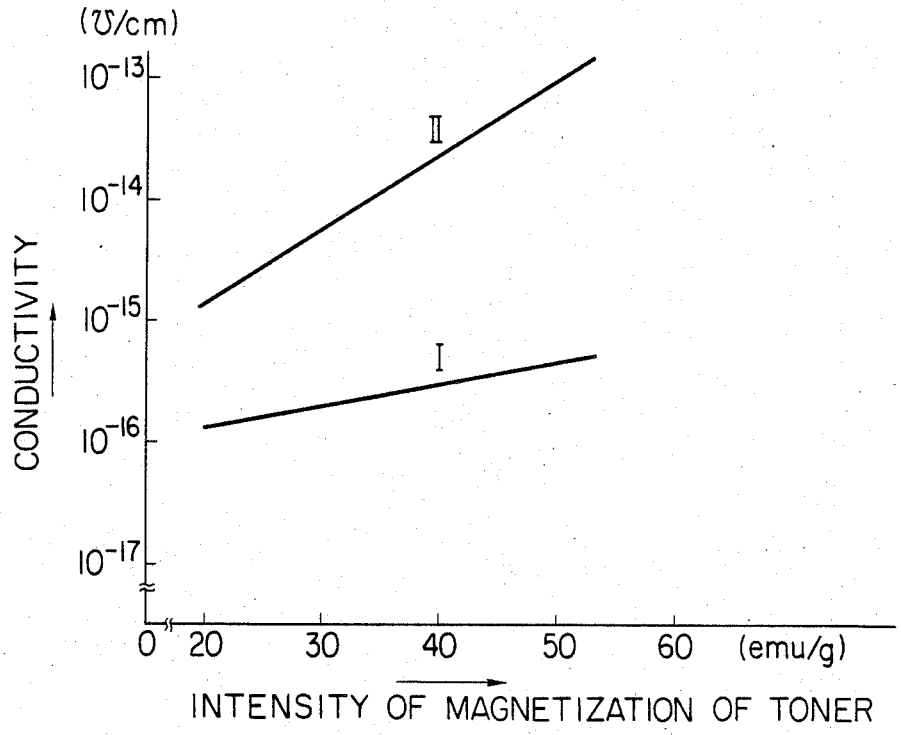
FIG. 5 is a graph showing curves, one curve for iron and the other for magnetite as the magnetic material, each representing the relation between the intensity of magnetization of and the conductivity of each toner.

Further, in the toner of the present invention, since by using iron or an alloy of iron as the magnetic material having an intensity of saturation magnetization of as high as not less than $150^{emu}/g$ the ratio of the magnetic material in the toner can be reduced, the conductive course is hardly formed. Consequently, the insulation of the toner is increased to restrain the leakage phenomenon of the true electric charge caused by triboelectric charge, and as a result the toner is improved to have a high developability. To define this more clearly, the measured results of the conductivity and attenuation rate of the magnetic toner will be given below:

FIG. 5 is a graph showing Curves I and II for iron and magnetite, respectively, each curve representing the relation between the intensity of magnetization of and the conductivity of each of toners prepared in the same manners as in the hereinafter described Example 1 except that iron or magnetite is used as the magnetic material, varying the ratio of the material in the toner. As may be understood from this figure, by comparison of toners having the same intensity of magnetization, the toner containing the magnetic material comprised of iron is considerably smaller in the conductivity than that containing the magnetic material comprised of magnetite, and, besides, the difference in the conductivity becomes conspicuous as the intensity of magnetization increases.

Figure 6:
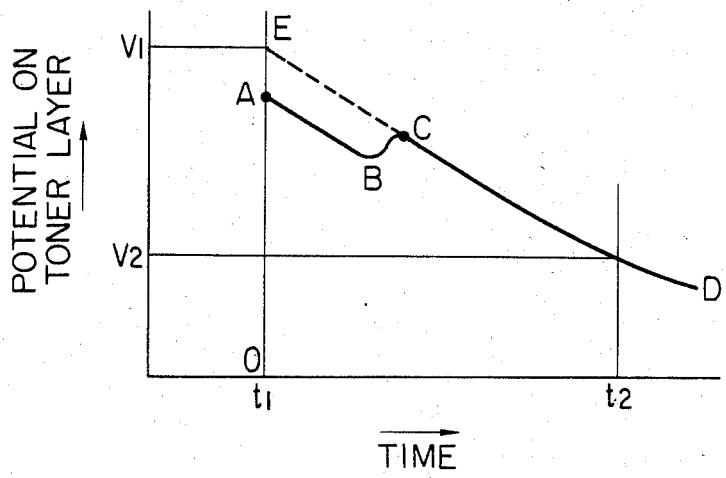
FIG. 6 is a graph showing a curve representing the change in the potential of the magnetic layer in the passage of time.

FIG. 6 is for obtaining knowledge about the attenuation rate of the charge in the magnetic toner, and is a graph showing a curve representing the change in the potential in the toner during the passage of time. This can be obtained by the following measuring procedure:

(1) A given areal development is made on a photoreceptor comprised of an organic photoconductive material to thereby prepare a sample.

(2) The sample is exposed to a scattered light. The exposure is made by using a fluorescent lamp light as the light source in the measuring example under the conditions: an illuminance of 200 to 300 lux and an exposure time of 0.5 to 3 seconds (controlled according to the thickness of the toner layer formed by the development).

(3) A transmission-type potentiometer is placed on the sample within 2 to 3 seconds after completion of the exposure to measure, spending about one minute, the surface potential of the toner layer (FIG. 6 A-B). The measurement-starting point of time is regarded as $t_1$. After that, the sample is exposed for more than 3 minutes to the foregoing light, and the surface potential of the toner layer is then measured (FIG. 6 B-C-D).

In addition, the exposure needs to be performed under a condition set so that Peak C appears and the line BC is smaller than the line OA.

In FIG. 6, if the potential at the point of time $t_1$ obtained by the extraporated line CE, in parallel with the line AB, extending from the point C is regarded as $V_1$ and if the potential at the point of time $t_2$ 3 minutes after the time $t_1$ is regarded as $V_2$, then the rate of change in the potential in the toner layer is expressed by the following formula:

$$\frac{V_1 - V_2}{V_1} \times 100\ (\%)$$

This rate of change represents the liability of the charge to permeate into the toner layer; in other words, the liability of the charge to attenuate, and is called "V leak."

The V leak value has close relation particularly to the uniformity of solid black or blur of image, and it is known that the smaller the V leak value, the smaller the attenuation of the charge in the toner, thus producing a uniformly sharp and excellent image. As is obvious from the example which will be described hereinafter, the magnetic toner of the present invention, which uses the magnetic material comprised of iron or an alloy of iron, has a V leak value smaller than that of the magnetic toner containing magnetite as the magnetic toner, and the resulting image is excellent in the uniformity of solid black.

Iron or an alloy of iron less negatively charges the binder resin than does an iron oxide such as magnetite and, besides, the ratio of it in the toner is allowed to be smaller, so that the ratio of the magnetic material to be bared on the surface of the toner is small, and as a result the triboelectric charging characteristic is easily controllable. Especially when obtaining a positively chargeable toner, because the amount of the magnetic material that is bared on the surface of the toner is small, the occurrence of the opposite-polar toner is restrained, and, consequently, the charged quantity distribution of the toner is narrowed down to thereby form a uniformly charged condition, thus causing the toner to have a high developability. Particularly, the reproduction of fine-line patterns of an image is improved and the occurrence of fringe between the fine lines is restrained, thereby producing a sharp image. And the reproduction of solid black areas and the image density also are improved to be excellent. As may be noticed from the above description, the greater the intensity of saturation magnetization of the magnetic material of the present invention is, the more preferable the magnetic material is, but its upper limit of $230^{emu}/g$ is satisfactory.

Further, since magnetite, which has heretofore been preferredly used as the magnetic material, is black, it is advantageous for preparing a black toner, but unable to be used for obtaining a colored toner. In contrast, iron or an alloy of iron, which is used as the magnetic material in the present invention, because it is metallically glossy white, can be used to produce any desired color-having toner by the addition of an appropriate coloring agent.

As has been mentioned, the present invention can provide an insulated magnetic toner which is capable of forming a satisfactory visible image having high density and sharpness, whose softening point is so low as to carry out fixation adequately and advantageously, and which is excellent in both developability and fixability.

Examples of the present invention will be illustrated below. The invention is not limited by the following examples. In addition, used in the following examples, the term "part(s)" represents part(s) by weight; the "Hc(M)" and "$\sigma$s(M)" represent the coercive force and intensity of saturation magnetization of a magnetic material, respectively; and the "Hc(I)" and "$\sigma$s(T)" represent the coercive force and intensity of saturation magnetization of a toner, respectively.

EXAMPLE 1

| | |
|---|---|
| Styrene-acryl resin (softening point 126° C.) | 70 parts |
| Alloy of iron (Fe—C) (Hc (M): 50 Oe, $\sigma s$ (M): $180^{emu}/g$) | 30 parts |
| Charge control agent (basic dye) | 2 parts |

The above materials were mixed, fusedly kneaded, pulverized and then classified, whereby a magnetic toner of the present invention was prepared which has an average particle size of 20 microns, a conductivity of $2.1\times10^{-15}$ ℧/cm, a softening point of 129° C., an Hc(I) of 50 Oe, and a $\sigma s$(T) of $41^{emu}/g$. This was regarded as Toner 1.

COMPARATIVE EXAMPLE 1

A comparative magnetic toner having an average particle size of 20 microns, a conductivity of $10^{-12}$ ℧/cm, a softening point of 132° C., an Hc(T) of 95 Oe, and a $\sigma s$(T) of $25^{emu}/g$ was prepared in the same manner as in Example 1 except that 50 parts of magnetite as the magnetic material having an Hc(M) of 100 Oe, a $\sigma s$(M) of $85^{emu}/g$. This was regarded as Comparative Toner 1.

Toner 1 and Comparative Toner 1, obtained in Example 1 and Comparative Example 1, were subjected to a charged quantity test by the known blow-off method and measurement for V leak value. These toners were then used to make an actual copying test in an electrophotographic copier U-Bix $V_2$ (manufactured by Konishiroku Photo Industry Co., Ltd.). The resulting copy image was measured with respect to the maximum image density and reproduction of fine lines (the number of lines per unit length). The obtained results are as given in Table 1.

TABLE 1

| | Toner 1 | Comparative toner 1 |
|---|---|---|
| Quantity of triboelectric charge ($\mu c/g$) | 12 | 5 |
| V leak value | 8.5 | 75.4 |
| Maximum image density | 1.5 | 0.9 |
| Reproduction of fine lines (lines/mm) | 6 | 3.5 |

EXAMPLES 2–10

| | |
|---|---|
| Styrene-acryl resin (softening point 126° C.) | 60 parts |
| Alloy of iron (Fe—C) (Hc (M): 50 Oe, $\sigma s$ (M): $180^{emu}/g$) | 40 parts |

The above materials and each of the coloring agents given in Table 2 were processed in the same manner as in Example 1, whereby magnetic toners of the present invention were prepared which each has an average particle size of 20 microns. These were regarded as Toners 2 to 10.

TABLE 2

| | Coloring agent | Quantity |
|---|---|---|
| Example 2 | Rose bengal | 3 parts |
| Example 3 | Rose bengal | 5 parts |
| Example 4 | Rose bengal | 10 parts |
| Example 5 | Aniline blue | 3 parts |
| Example 6 | Aniline blue | 5 parts |
| Example 7 | Aniline blue | 10 parts |
| Example 8 | Chrome yellow | 3 parts |

TABLE 2-continued

| | Coloring agent | Quantity |
|---|---|---|
| Example 9 | Chrome yellow | 5 parts |
| Example 10 | Chrome yellow | 10 parts |

COMPARATIVE EXAMPLES 2–4

| | |
|---|---|
| Styrene-acryl resin (softening point 126° C.) | 60 parts |
| Magnetite (Hc (M): 100 Oe, $\sigma s$ (M): $85^{emu}/g$) | 40 parts |

The above materials and each of the coloring agents given in Table 3 were processed in the same manner as in Example 1, whereby comparative magnetic toners were prepared which each has an average particle size of 20 microns. These were regarded as Comparative Toners 2 to 4.

TABLE 3

| | Coloring agent | Quantity |
|---|---|---|
| Comparative example 2 | Rose bengal | 10 parts |
| Comparative example 3 | Aniline blue | 10 parts |
| Comparative example 4 | Chrome yellow | 10 parts |

Each of the above Toners 2 to 10 and Comparative Toners 2 to 4, obtained in Examples 2 to 10 and Comparative Examples 2 to 4, was dissolved into a solvent, and each of the resulting solutions was coated on a resin-coated paper, which was then examined with respect to its color tone and covering power. In addition, the covering power was determined by measuring with a grindometer in accordance with JIS K-5101. The results are as given in Table 4.

TABLE 4

| | Color tone | Covering power |
|---|---|---|
| Toner 2 | Δ | X |
| Toner 3 | ○ | Δ |
| Toner 4 | ◎ | ○ |
| Toner 5 | Δ | X |
| Toner 6 | ○ | Δ |
| Toner 7 | ◎ | ○ |
| Toner 8 | Δ | X |
| Toner 9 | ○ | Δ |
| Toner 10 | ◎ | |
| Comparative Toner 2 | X | ○ |
| Comparative Toner 3 | X | ○ |
| Comparative Toner 4 | X | ○ |

EXAMPLE 11

Toners 11 and 12 of this invention and Comparative toner 5 having average particle size of 20 microns respectively were prepared in the same manner as in Example 1 except that following material was used.

| | |
|---|---|
| Toner 11 | |
| Styrene-acryl resin (Softening point 126° C.) | 60 parts |
| Alloy of iron (Fe—Ni—Al—Ti; 81:15:3:1) (Hc (M): 30 Oe, Os (M): 150 emu/g) | 40 parts |
| Rose bengal | 10 parts |
| Toner 12 | |
| Styrene-acryl resin (Softening point 126° C.) | 60 parts |

-continued

| | |
|---|---|
| Alloy of iron (Fe—Al—Si; 84.5:5.5:10) (He (M): 0.1 Oe, Os (M): 160 emu/g) | 40 parts |
| Rose bengal | 10 parts |
| Comparative toner 4 | |
| Styrene-acryl resin (Softening point 126° C.) | 60 parts |
| Alloy of iron (Fe—Co—V; 38.5:52:9.5) Hc (M): 100 Oe, Os M): 200 emu/g | 40 parts |
| Rose bengal | |

Toners 11 and 12 and Comparative toner 5 thus obtained were used to make an actual copying test in an electrophotographic copier U-Bix V2 (manufactured by Konishiroku Photo Industry Co., Ltd.).

The resulting copy image was mesured with respect to the maximum image density and reproduction of fine line (the number of lines per unit length: sharpness). The obtained results are given in Table 5.

TABLE 5

| | maximum image density | sharpness |
|---|---|---|
| Toner 11 | 1.4 | 6 |
| Toner 12 | 1.3 | 7 |
| Comparative toner 4 | 1.0 | 4 |

What is claimed is:

1. An insulated magnetic toner comprising a binder resin and a powdery magnetic material, said magnetic material being iron or an alloy thereof having a coercive force of not more than 60 Oe and an intensity of saturation magnetization of not less than $150^{emu}/g$, said magnetic material comprising 20 to 70% by weight of said binder resin.

2. The insulated magnetic toner according to claim 1, wherein the principal ingredient of said iron alloy is iron.

3. The insulated magnetic toner according to claim 2, wherein said alloy having iron as a principal ingredient contains, as the ingredient other than iron, at least one of the elements selected from carbon, phosphor, boron, silicon, aluminum, nickel, cobalt, copper, chromium, zinc, titanium, molybdenum and tungsten.

4. The insulated magnetic toner according to claim 1, wherein the conductivity of said insulated magnetic toner is not more than $10^{-12}$ ʊ/cm.

5. The insulated magnetic toner according to claim 1, wherein an average particle size of said magnetic material in the powdery form is within a range from 0.1 μm to 3 μum.

6. The insulated magnetic toner according to claim 1, wherein the intensity of saturation magnetization of said magnetic material is within a range from $150^{emu}/g$ to $230^{emu}/g$.

7. The insulated magnetic toner according to claim 1, wherein said iron alloy is an alloy of iron and carbon.

8. The insulated magnetic toner according to claim 1, wherein 20% by weight to 70% by weight of magnetic material is contained in said binder.

9. The insulated magnetic toner according to claim 1, wherein said binder resin is at least one member selected from the group consisting of styrene-acryl resin, polyester resin, epoxy resin, styrene-butadiene resin, butyral resin and cellulose resin.

10. The insulated magnetic toner according to claim 1, wherein said insulated magnetic toner contains coloring agent.

11. The insulated magnetic toner according to claim 1, wherein said insulated magnetic toner contains coloring agent.

12. An insulated magnetic toner comprising a binder resin and a powdery magnetic material, said magnetic material being iron or an alloy thereof having a coercive force of not more than 60 Oe and said binder resin having an intensity of saturation magnetization of 20 to $45^{emu}/g$.

13. The insulated magnetic toner according to claim 12, wherein the principal ingredient of said iron alloy is iron.

14. The insulated magnetic toner according to claim 13, wherein said alloy having iron as a principal ingredient contains, as the ingredient other than iron, at least one of the elements selected from carbon, phosphor, boron, silicon, aluminum, nickel, cobalt, copper, chromium, zinc, titanium, molybdenum and tungsten.

15. The insulated magnetic toner according to claim 12, wherein the conductivity of said insulated magnetic toner is not more than $10^{-12}$ ʊ/cm.

16. The insulated magnetic toner according to claim 12, wherein an average particle size of said magnetic material in the powdery form is within a range from 0.1 μm to 3 μm.

17. The insulated magnetic toner according to claim 12, wherein the intensity of saturation magnetization of said magnetic material is within a range from $150^{emu}/g$.

18. The insulated magnetic toner according to claim 12, wherein said iron alloy is an alloy of iron and carbon.

19. The insulated magnetic toner according to claim 12, wherein said binder resin is at least one member selected from the group consisting of styrene-acryl resin, polyester resin, epoxy resin, styrene-butadiene resin, butyral resin and cellulose resin.

* * * * *